US012286278B2

(12) United States Patent
Jagger

(10) Patent No.: US 12,286,278 B2
(45) Date of Patent: Apr. 29, 2025

(54) CONTAINER ASSEMBLY

(71) Applicant: Robin Drummond Jagger, Bayswater Wa (AU)

(72) Inventor: Robin Drummond Jagger, Bayswater Wa (AU)

(73) Assignee: MAM BABY AG, Wollerau (CH)

( * ) Notice: Subject to any disclaimer, the term of this patent is extended or adjusted under 35 U.S.C. 154(b) by 75 days.

(21) Appl. No.: 17/999,886

(22) PCT Filed: May 25, 2021

(86) PCT No.: PCT/AU2021/050491
§ 371 (c)(1),
(2) Date: Nov. 25, 2022

(87) PCT Pub. No.: WO2021/237278
PCT Pub. Date: Dec. 2, 2021

(65) Prior Publication Data

US 2023/0234758 A1 Jul. 27, 2023

(30) Foreign Application Priority Data

May 28, 2020 (AU) ..... 2020901755

(51) Int. Cl.
*B65D 47/20* (2006.01)
*A47G 19/22* (2006.01)
(Continued)

(52) U.S. Cl.
CPC ..... *B65D 47/2018* (2013.01); *A47G 19/2272* (2013.01); *B65D 1/32* (2013.01);
(Continued)

(58) Field of Classification Search
CPC .... B65D 47/2018; B65D 1/32; B65D 43/022; B65D 2543/00046; B65D 2543/00092;
(Continued)

(56) References Cited

U.S. PATENT DOCUMENTS 9,241,588 B2 * 1/2016 Dunn ..... A47G 19/2272
2018/0279815 A1 10/2018 Hakim

FOREIGN PATENT DOCUMENTS

EP 3266352 1/2018
WO 2018/215769 11/2018

OTHER PUBLICATIONS

International Search Report, Australian Patent Office, Application No. PCT/AU2021/050491, Jul. 28, 2021.
(Continued)

*Primary Examiner* — James N Smalley
(74) *Attorney, Agent, or Firm* — Gottlieb, Rackman & Reisman, PC

(57) ABSTRACT

The invention relates to a lid for releasable attachment to a container for containment of fluid, the container having an opening defined by a first rim, the lid comprising a body having a second rim adapted for abutment onto the first rim, and a flange comprising a body having an outer periphery for abutment to an inner surface of the container, wherein the body of the flange is adapted to permit fluid flow through the flange to exit the container between the first and second rim. There is also provided an abutment assembly of the container being adapted to receive the second rim of the lid for selectively displacing at least one portion of the second rim of the lid to allow fluid to exit the container. In an arrangement, the abutment assembly may be of the second rim.

30 Claims, 9 Drawing Sheets

(51) Int. Cl.
*B65D 1/32* (2006.01)
*B65D 43/02* (2006.01)

(52) U.S. Cl.
CPC .. *B65D 43/022* (2013.01); *B65D 2543/00046* (2013.01); *B65D 2543/00092* (2013.01); *B65D 2543/00305* (2013.01); *B65D 2543/00509* (2013.01)

(58) Field of Classification Search
CPC ..... B65D 2543/00305; B65D 2543/00509; B65D 43/0214; B65D 51/1644; A47G 19/2272
USPC ..... 220/714
See application file for complete search history.

(56) References Cited

OTHER PUBLICATIONS

Written Opinion of the International Searching Authority, Australian Patent Office, Application No. PCT/AU2021/050491, Jul. 28, 2021.
Written Opinion of the International Preliminary Examining Authority, Australian Patent Office, Application No. PCT/AU2021/050491, May 6, 2022.

* cited by examiner

CONTAINER ASSEMBLY

TECHNICAL FIELD

The present invention relates to containers, in particular to drinking containers.

The invention has been devised particularly, although not necessarily solely, in relation to self-sealing drinking containers.

BACKGROUND ART

The following discussion of the background art is intended to facilitate an understanding of the present invention only. The discussion is not an acknowledgement or admission that any of the material referred to is or was part of the common general knowledge as at the priority date of the application.

Self-Sealing containers are particularly useful when used as drinking containers by toddlers and disabled and sick people. This is particularly true because, self-sealing containers do not require to be actuated for closure when the users decide to stop drinking, for example, fluids contained in these containers.

An example of a self-sealing container is disclosed in U.S. Pat. No. 3,727,808. The container disclosed in this patent requires actuation of a valve in order to able to drink from this particular container. Thus, this container is not suitable for toddlers and people having a disability that impedes them from actuating the valve prior consuming the content of the container.

Furthermore, other self-sealing containers have been developed with the objective of facilitating actuation of the drinking container prior consuming the content of the containers making them particular useful for toddlers, and the disabled and sick. Examples of these containers are disclosed in US patent publications 2011/0084084 and US2015/0102032. The containers disclosed in these patent documents comprise a main chamber for containment of the fluid to be consumed by the users, a rigid collar (for attachment to the main chamber) comprising openings to allow fluid flow therethrough and a relative soft and deformable cover for covering of the collar to control fluid flow out of the container. There are also provided flow rings (for example, part of the collars) that keep the soft cover in place. In operation, the user of these containers may deform the deformable covers (mounted on the rigid collars) by applying a force to permit fluid flow out of the container.

It is known that the rate of fluid flow is relatively low when fluids are being drunk out of these particular self-sealing containers; thus drinking fluid from these containers is not satisfactory and can be particularly frustrating for the actual users of these self-sealing containers, which are mainly toddlers and the disabled and sick.

One of the reasons of the relatively low rate of fluid flow is the presence of the flow rings, which are used for keeping the soft cover in place. The flow rings of the collars of the conventional self-sealing containers are of rigid construction, thus hindering proper deformation of the soft covers mounted on the collars of these conventional self-sealing containers.

Furthermore, another disadvantage of the conventional self-sealing containers is that the presence of the collar typically encourages dirt and mold to built-up, which is difficult to remove due to the particular construction of the collar or due to not being visible. The build-up of mold and dirt can represent a health danger for the particular population that typically uses self-sealing containers such as toddlers and the disabled and sick.

It is against this background that the present invention has been developed.

SUMMARY OF INVENTION

According to a first aspect of the invention there is provided a lid for releasable attachment to a container for containment of fluid, the container having an opening defined by a first rim, the lid comprising a body having a second rim adapted for abutment onto the first rim, and a flange comprising a body having an outer periphery for abutment to an inner surface of the container, wherein the body of the flange is adapted to permit fluid flow through the flange to exit the container between the first and second rim.

Preferably, the body of the flange is spaced apart from the second rim of the lid defining a passage to facilitate fluid flow between the flange and the second rim.

Preferably, the flange is adapted to generate a friction force to resist movement between the lid and the container.

Preferably, the lid is configured in such a manner that the lid is releasably secured to the container acting as a plug fastened to the container via the friction force.

Preferably, the outer periphery of the body of the flange is adapted to abut an inner surface of the container generating the friction force.

Preferably, the body of the lid comprises a cap and the flange surrounding a particular portion of the cap.

Preferably, the cap comprises a reinforcing ring defined by a circular protrusion extending below the flange Preferably, the reinforcing ring defines an area surrounded by the reinforcing ring, the area is adapted to be compressed creating a pushing force from the flange into the inner surface of the container.

In a particular arrangement, the inner surface comprises a plurality of ribs protruding from the inner surface arranged in a spaced apart relationship with respect to each other around the inner surface.

Preferably, the body of the flange is configured as a disc-shaped body being adapted to permit fluid flow through the flange and having an outer periphery defining a side wall for abutment to the inner surface of the container.

Preferably, the body of the flange comprises at least one opening to allow fluid flow through the flange.

Preferably, the cap is of conical configuration with an upper section having a larger diameter than its lower section.

Preferably, the cap is configured as an inverted hollow cone.

Preferably, the lower section of the cap comprises a lower surface.

Preferably, the lower surface comprises valve means.

Preferably, the valve means are surrounded by the reinforcing ring.

Preferably, the flange is configured in such a manner that the flange is snuggly fitted when mounted on an inner ridge of the container and surrounded by the inner surface of the container.

Preferably, the area of the body of the cap located between the flange and second rim is adapted to be compressed to generate a pushing force.

Preferably, the body of the lid is manufactured out of silicon.

Preferably, the silicon has a shore hardness of between 50 A and 70 A.

Preferably, the body of the flange is adapted to allow fluid flow from the interior of the container towards the first and second upper rims to permit exit of fluid from the container upon deformation of the junction defined by the first and second rim.

Preferably, the diameter of the flange is larger than the diameter of the container at the location of the inner surface.

Preferably, the second rim is adapted to be selectively displaced between an undeformed condition and a deformed condition to allow fluid to exit the container.

Preferably, the inner surface comprises a plurality of ribs protruding from the inner surface arranged in a spaced apart relationship with respect to each other around the inner surface.

According to a second aspect of the invention there is provided an abutment assembly of a container having an opening defined by a first rim for receiving a lid comprising a body having a second rim adapted for abutment onto the first rim, wherein the second rim is adapted to be selectively displaced between an undeformed condition and a deformed condition, the abutment assembly being adapted to receive the second rim for selectively displacing at least one portion of the second rim of the lid, the abutment assembly comprising a plurality of ridges arranged in a spaced apart relationship with respect to each other around an inner surface of the first rim of the container, the plurality of ridges comprises at least one pair of first ridges and at least one second ridge located between the pair of first ridges, the first ridges extending a first distance from an inner surface of the container and the second ridges extending a second distance from the inner surface of the container, wherein the first distance is greater than the second distance.

Preferably, the inner surface of the container is located below first rim of the container.

Preferably, the abutment assembly is adapted to define a seal once receiving the second rim of the lid.

According to a third aspect of the invention there is provided a container having an opening defined by a first rim, wherein the first rim is adapted to receive the second rim of a lid adapted to be selectively displaced between an undeformed condition and a deformed condition when mounted on the first rim, wherein the container comprises an abutment assembly in accordance with the second aspect of the invention to deform the second rim upon application of a deforming action to allow fluid flow between the first and second rim.

Preferably, the lid is directly attached to the first rim.

Preferably, the lid comprises the lid in accordance with the first aspect of the invention.

According to a fourth aspect of the invention there is provided an abutment assembly of a lid being adapted to be attached to a container having an opening defined by a first rim for receiving the lid, the lid comprising a body having a second rim having a lower surface adapted for abutment onto the first rim, wherein the second rim is adapted to be selectively displaced between an undeformed condition and a deformed condition, the abutment assembly comprising a plurality of protrusions arranged in a spaced apart relationship with respect to each other around the lower surface of the second rim of the container.

According to a fifth aspect of the invention there is provided a lid being adapted to be attached to a container having an opening defined by a first rim for receiving the lid, the lid comprising a body having a second rim having a lower surface adapted for abutment onto the first rim, wherein the second rim is adapted to be selectively displaced between an undeformed condition and a deformed condition, wherein the lid comprises an abutment assembly comprising a plurality of protrusions arranged in a spaced apart relationship with respect to each other around the lower surface of the second rim of the container.

According to a sixth aspect of the invention there is provided a container assembly comprising the lid in accordance with the first aspect of the invention and a container as defined in accordance with the third aspect of the invention.

BRIEF DESCRIPTION OF THE DRAWINGS

Further features of the present invention are more fully described in the following description of several non-limiting embodiments thereof. This description is included solely for the purposes of exemplifying the present invention. It should not be understood as a restriction on the broad summary, disclosure or description of the invention as set out above. The description will be made with reference to the accompanying drawings in which.

It should be noted that the figures are schematic only and the location and disposition of the components can vary according to the particular arrangements of the embodiments of the present invention as well as of the particular applications of the present invention.

DESCRIPTION OF EMBODIMENT(S)

FIGS. 1 to 7 show a particular arrangement of a container assembly 10 in accordance with an embodiment of the present embodiment of the invention.

Figure 1:
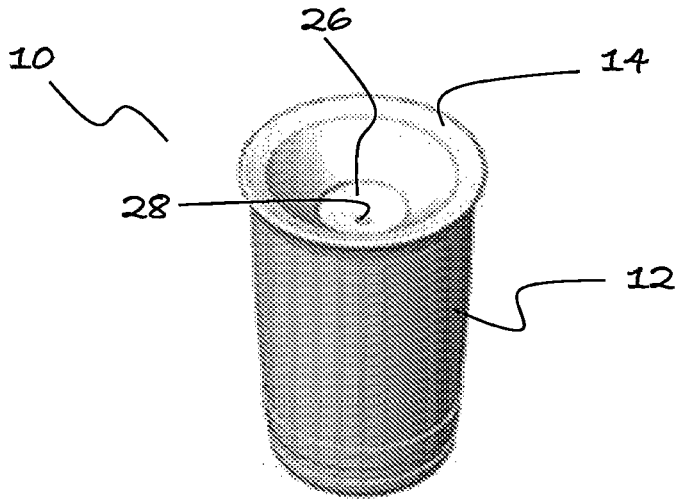
FIG. 1 is top perspective view of a particular arrangement of a container assembly in accordance with an embodiment of the invention in the closed condition.
Figure 2:
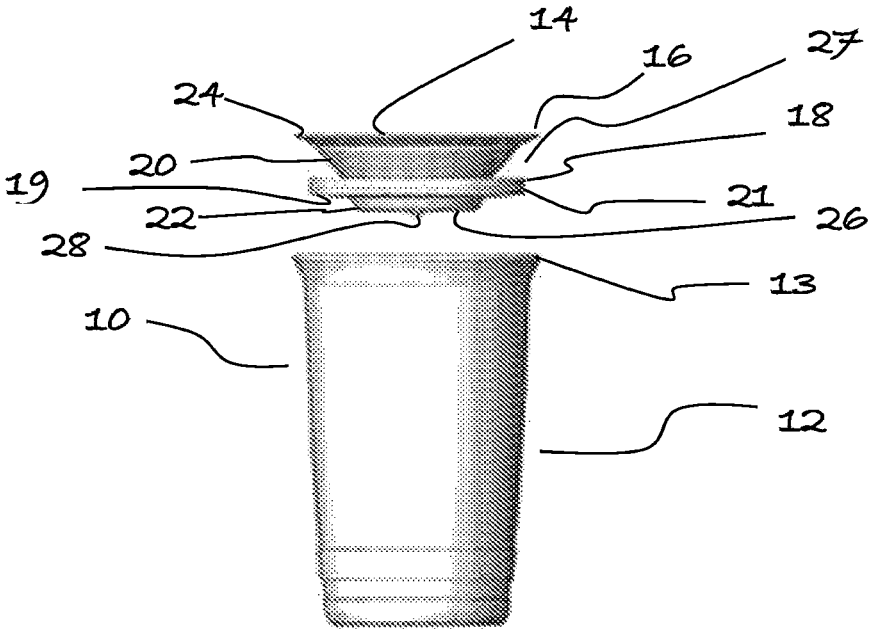
FIG. 2 is a side perspective exploded view of the container assembly shown in FIG. 1 with its lid removed.

As shown in FIGS. 1 and 2, the container assembly 10 comprises a container 12 for receiving, for example, a drinking fluid, and a lid 14 adapted to be releasably attached to the container 12 for closing of the container 12. The container 12 comprises a container upper rim 13 (the first rim) adapted for receiving a lid upper rim 24 (the second rim) of the lid 14 to allow selectively sealing and unsealing the container assembly 12, respectively, allowing fluid to exit the container 12 and impeding exit of fluid from the container 12.

As will be described with the method of operation of the container assembly 10, the lid 14 is configured in such a manner that the lid 14 is releasably secured to the container 12 acting as a plug fastened to the container 12 via a friction force generated through abutment between particular parts of the lid 14 and the container 12, such as: one or more inner surfaces of the container 12 and a side wall of the lid 14.

FIG. 2 is an exploded view of the container 12 showing the lid 14 removed from the container 12.

As shown in FIG. 2, the lid 14 comprises a cap 16 and a flange 18 surrounding a particular portion of the cap 16. The flange 18 comprises a body comprising an outer periphery for abutment to the inner surface 17 of the container 12.

In the particular arrangement shown in the figures, the body of the flange 18 is configured as a disc-shaped body having a lower surface 19 and an outer periphery defining a side wall 21. And, the cap 16 is of conical configuration with an upper section 20 having a larger diameter than its lower section 22. The cap 16 is configured as an inverted hollow cone as best seen in FIG. 1.

The upper section 20 of the cap 16 comprises a lid upper rim 24 (the second rim) for abutment to the container 12 when the lid 14 is mounted onto the container 12.

Figure 3:
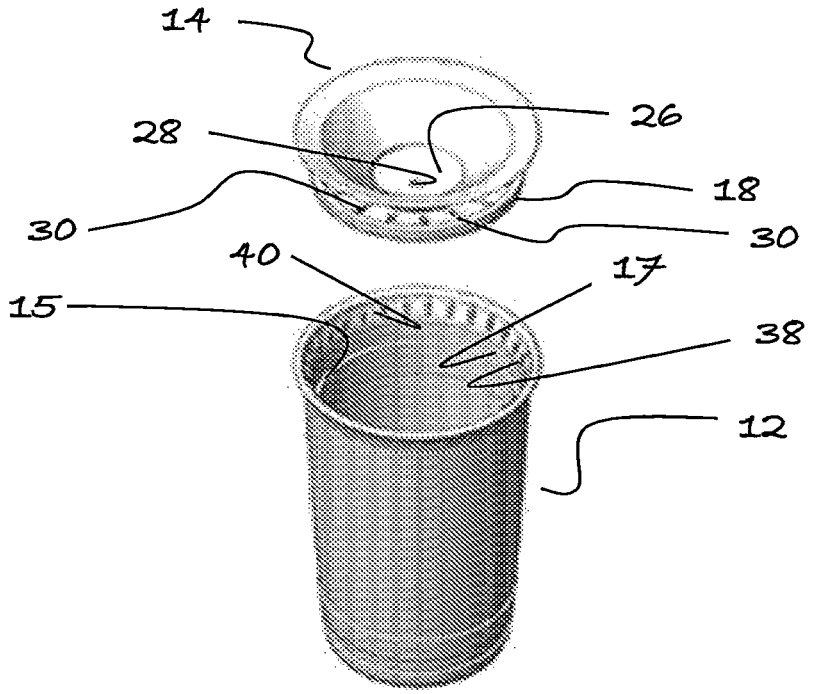
FIG. 3 is a top perspective exploded view of the container assembly shown in FIG. 1 with its lid removed.

The lower section 22 comprises a lower surface 26 (better seen in FIG. 1 or 3). The lower surface 26 comprises valve means 28 permitting air to enter the container 12 during use of container assembly 10.

Further, the flange 18 (of the lid 14) surrounds the lower section 22 of the cap 16 at a location spaced apart from the lower surface 26 of the cap 16, as shown in, for example, FIG. 2.

The flange 18 is adapted to be received within the container 12 and secured within the container 12 impeding unintentional opening of the container assembly 10; in this manner, the lid 16 is directly releasably attached (acting as a plug) to the container 12 without, for example, the need of a rigid collar as occurs in the prior art.

Figure 4:
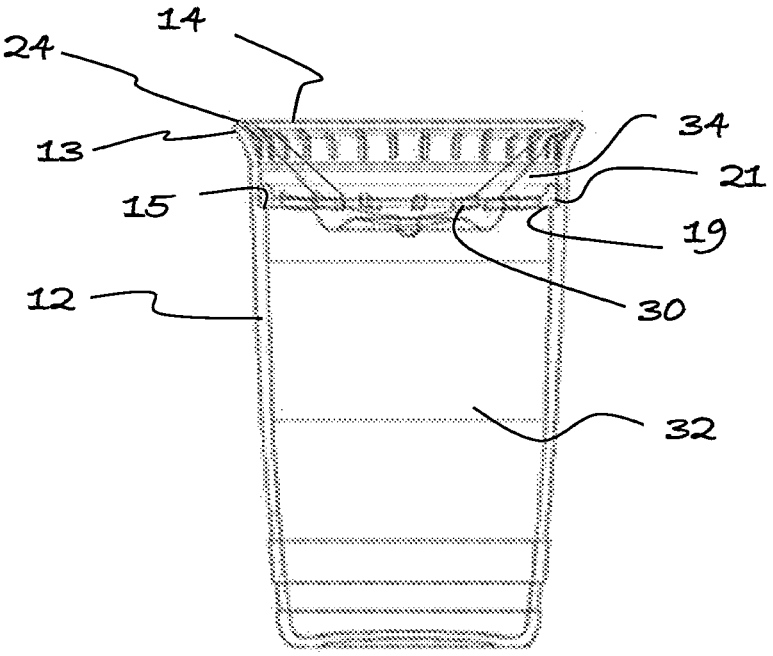
FIG. 4 is a side transparent view of the container assembly shown in FIG. 1.

The container 12 comprises an inner ridge 15 (see FIGS. 3 and 7) for receiving the lower surface 19 and side wall 21 of the flange 18—see FIG. 4. This particular arrangement, in which the flange 18 sits on the inner ridge 15 and its side wall 21 being surrounded by the inner surface 17 (located just above the ridge 15) secures the lid 14 to the container 12.

Securing of the lid 14 onto the container 12 occurs because the flange 18 is configured in such a manner that the flange 18 is snuggly fitted when mounted on the ridge 15 and surrounded by the inner surface 17 located just above the ridge 15; thus, generating a friction force resisting relative motion between the flange 18 and the inner surface 17 of the container 12, unless a particular force is applied to the lid 14 to permit removal of the lid 14 and opening of the container assembly 10.

In particular, the lid 14 is secured within the container 12 due to: (1) the particular configuration of the lid 14 such as the flange 18 having a diameter larger than the diameter of the container 12 at the location above the ridge 15, (2) the shore hardness of the material (e.g. silicon) used for manufacturing the lid 14, and (3) the pressure exerted by the flange 18 (due to its larger diameter) against the inner surface 17 defining a negative tolerance between the side wall 21 of the flange 18 against the inner surface 17 of the container 12.

In particular, as shown in, for example, FIG. 8, the cap 16 comprises a reinforcing ring 23 defined by a circular protrusion extending below the flange 18 and surrounding the valve means 28 to avoid the valve means 28 to close when the lid 14 is inserted into the container 12.

Figure 8:
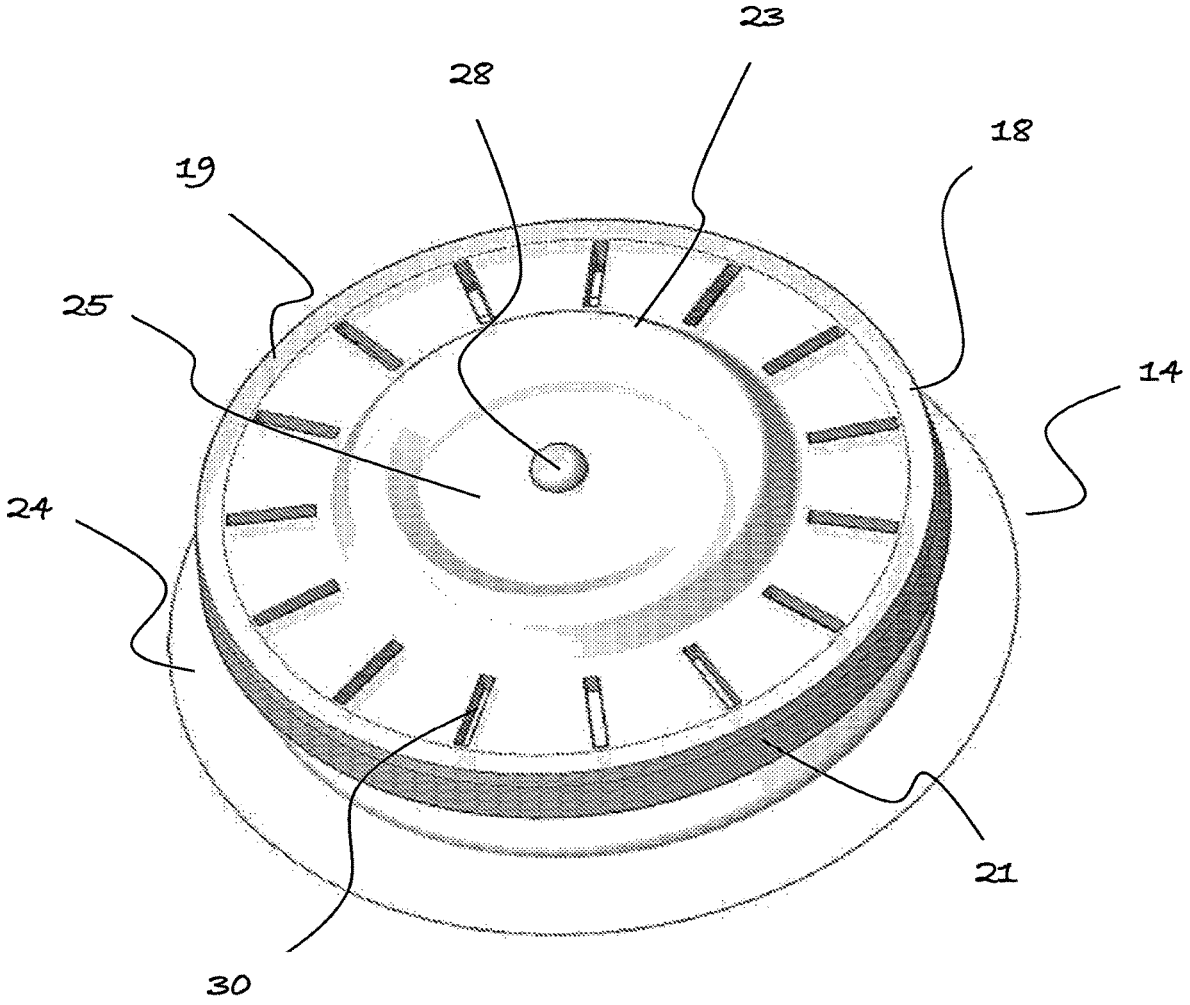
FIG. 8 is a top perspective view of the bottom of the lid shown in FIG. 6.
Figure 9:
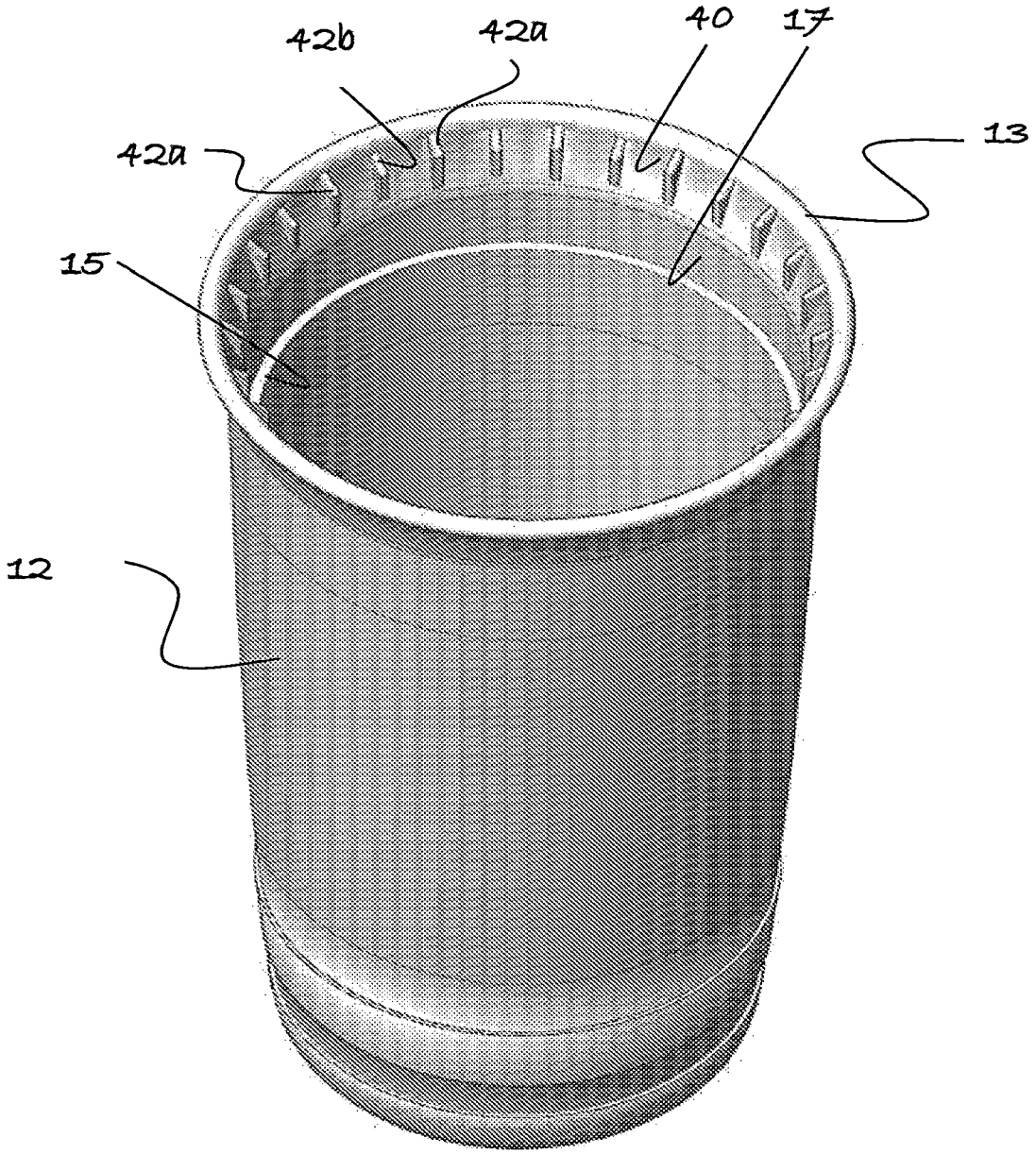
FIG. 9 is a top perspective view of the container shown in FIG. 1.

As mentioned above, the reinforcing ring 23 surrounds the valve means 28, thus defining an area 25 surrounded by the reinforcing ring 23 with the valve means 28 located in the centre as shown in FIG. 8. The area 25 is compressed into a slight dome shape when the lid 14 is attached to the container 12. The compression of this particular area 25 creates a pushing force from the flange 18 into the inner surface 17 of the container 12. In a particular arrangement, the lid 14 may be made out of a silicon having a shore hardness of between 50 A and 70 A.

Moreover, the flange 18 is adapted to allow fluid flow from the interior of the container 12 to the upper rims 13 and 24.

As will be described with respect to the method of operation of the container assembly 10, during use of the container assembly 10, the fluid contained in the container 12 will flow out of the container assembly 10 between the upper rims 13 and 24 of the container 13 and lid 14; in particular, the flow of fluid exits the container 12 upon deformation of the lid upper rim 24 of the lid 14.

In a particular use of the container assembly 10, deformation may occur by a deforming action produced by a user of the container assembly 10) between which the upper rims 13 and 24 of the container 12 and lid 14 are located, while drinking of the fluid by the user.

In particular, the deforming action may include squeesing, sucking, sipping and pulling actions applied by the user through her/his mouth.

Referring now to FIG. 3, as mentioned before, during use of the drinking assembly 10, the fluid flows (for example, due to tilting of the container assembly 10) from the interior of the container 12 towards the upper rims 13 and 24 of the container 12 and lid 14 when the container assembly 10 is in closed condition.

In order for the fluid to reach the container upper rim 13 of the container 12, the fluid needs to traverse the flange 18; for this to occur, as shown in, for example, FIG. 3, the flange 18 comprises one or more openings 30. The presence of the opening(s) 30 in the flange 18 permits flow of fluid to the container upper rim 13 of the container 12 when the container assembly 10 is tilted by its user.

As shown in FIG. 4, the lower area 32 of the container 12 (located below the inner ridge 15 of the container 12) is fluidly connected via the opening(s) 30 to the upper area 34 of the container 12 (located above the inner ridge 15 of the container 12), permitting fluid to reach the upper rims 13 and 24.

Figure 5:
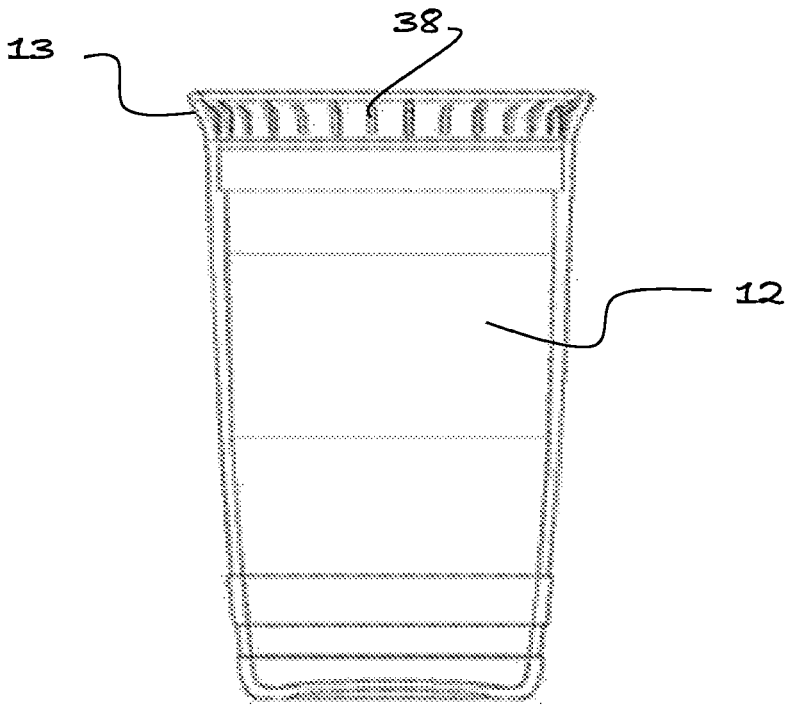
FIG. 5 is a side cross-sectional view of the container of the container assembly shown in FIG. 1.
Figure 6:
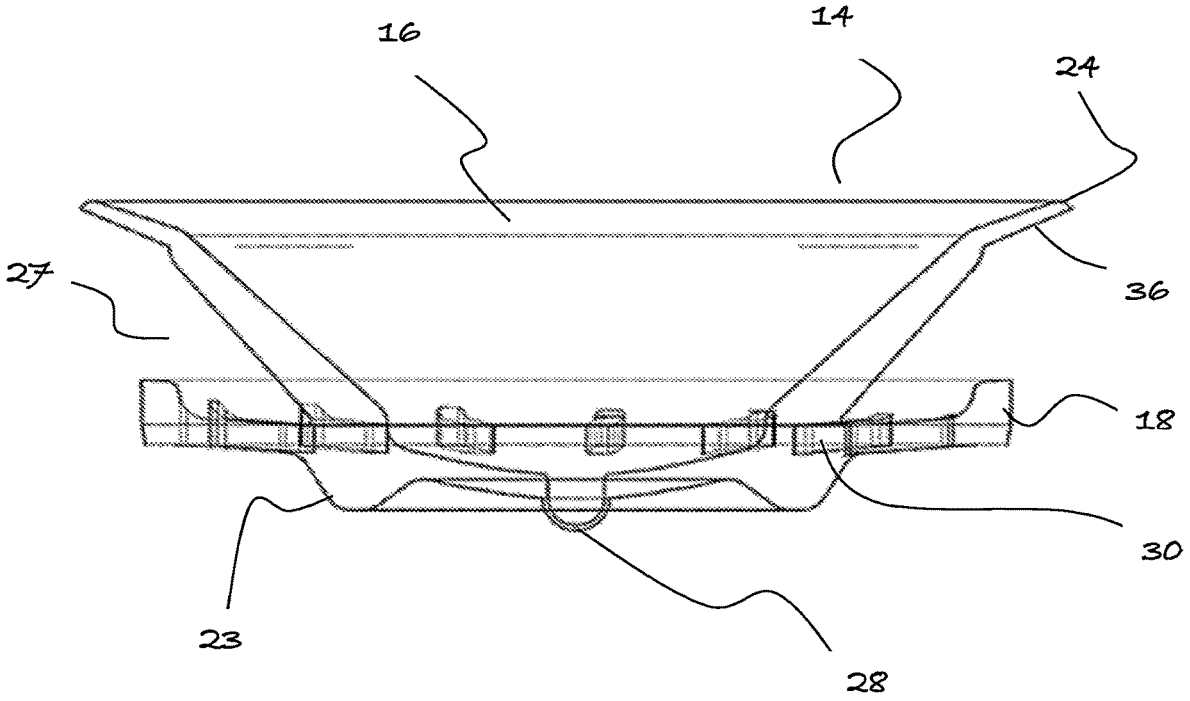
FIG. 6 is side cross-sectional view of the lid of the container shown in FIG. 1.
Figure 7:
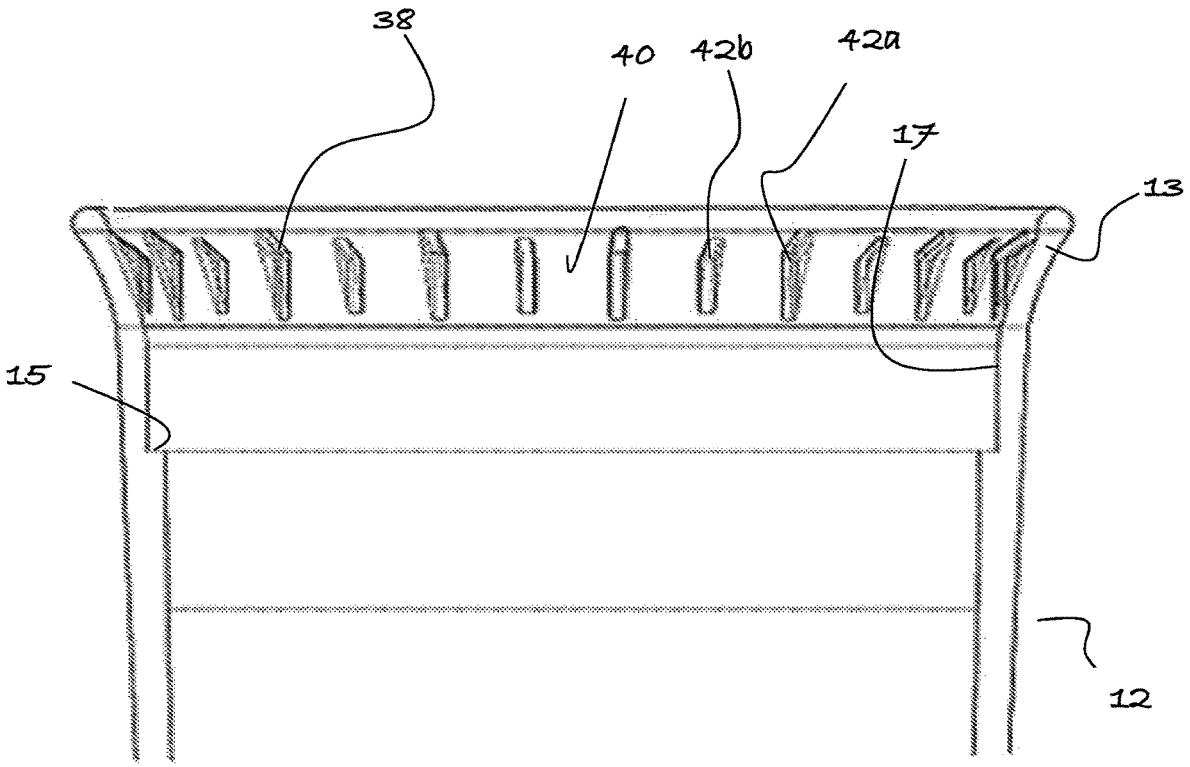
FIG. 7 is a side cross-sectional view of the upper section of the container of the container assembly shown in FIG. 1.

Referring now to FIGS. 5 to 7. As mentioned before (1) the container upper rim 13 of the container 12 is adapted to receive the lid upper rim 24 of the body of the lid 14, and (2) upon deformation of the lid upper rim 24 allows exit of the fluid from the container assembly 10; thus, the junction defined by the upper rims 13 and 24 (when the lid 14 is mounted onto the container 10) defines a seal impeding exit of the fluid requiring deformation of the junction to permit the fluid to flow through the junction defined by the upper rims 13 and 24.

The seal that impedes exit of fluid is defined by the container upper rim 13 of the container 12 being configured such that when the lower surface 36 of the lid upper rim 24 (see FIG. 6) is received by the container upper rim 13, a sealed junction is defined impeding flow of the fluid through the sealed junction. Fluid flow through the sealed junction is permitted when deformation of the junction occurs by action of, for example, the user's lip.

In the particular arrangement shown in the figures, the container upper rim 13 of the container 12 comprises an abutment assembly 38 for receiving the lower surface 36 of the lid upper rim 24 of the cap 16—see FIG. 5. The abutment assembly 38 is adapted to define the sealed junction (the seal) once receiving the lower surface 36 of the lid upper rim 24 of the cap 16. The abutment assembly 38 is located on the inside of the container 12 just below the top of the container upper rim 13.

In an arrangement, there is provided a lid 14 for releasable attachment to a container 12 for containment of fluid, the container 12 having an opening defined by a first rim 13, the lid 14 comprising a body having a second rim 24 adapted for abutment onto the first rim 14, and a flange 18 comprising a body having an outer periphery for abutment to an inner surface 17 of the container 12, wherein the body of the flange 18 is adapted to permit fluid flow through the flange 18 to exit the container 12 between the first rim 14 and second rim 24.

Figure 10:
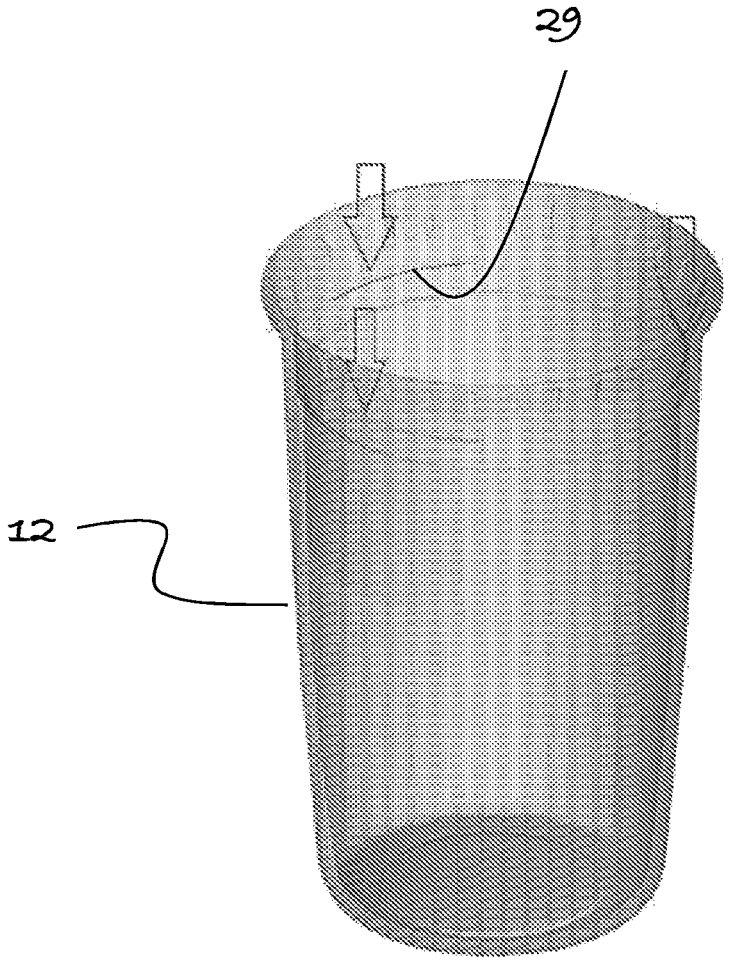
FIG. 10 shows a perspective view of a particular arrangement of the container shown in FIG. 3.

As shown in FIG. 10, in a particular arrangement, the inner surface 17 comprises a plurality of ribs 29 protruding from the inner surface 17. The ribs 29 are arranged in a spaced apart relationship with respect to each other around the inner surface 17. The inclusion of the ribs 29 is particular useful because it helps to keep the lid 14 attached to the container 12 because when the lid 14 is inserted, deformation of at least the side wall 21 of the flange 18 of the lid 14 occurs due to the presence of the ribs 29. FIG. 10 shows the container 12 as translucent for illustration purposes only.

Moreover, the container 12 shown in FIG. 10 shows an alternative arrangement of a container 12 when compared to the container 12 shown in the remaining figures. This alternative arrangement of container 12 does not comprise the ribbing shown at the bottom area of the container 12 in the remaining FIGS. 1 to 9.

The body of the flange 18 is spaced apart from the second rim 24 of the lid 14 defining a passage 27 to facilitate fluid flow between the flange 18 and the second rim 24. The side wall 21 of the body of the flange 18 is adapted to abut an inner surface 17 of the container 12 generating a friction force attaching the lid 14 to the container 12.

There is provided an abutment assembly 38 of the container 12 having an opening defined by the first rim 13 for receiving a lid 14 comprising a body having a second rim 24 adapted for abutment onto the first rim 13, wherein the second rim 24 is adapted to be selectively displaced between an undeformed condition and a deformed condition, the abutment assembly 38 being adapted to receive the second rim 24 for selectively displacing at least one portion of the second rim 24 of the lid 14, the abutment assembly 38 comprising a plurality of ridges 42 arranged in a spaced apart relationship with respect to each other around an inner surface 40 of the container 12, the plurality of ridges 42 comprises at least one pair of first ridges 42*a* (the raised ridges) and at least one second ridge 42*b* (the lower ridges) located between the pair of first ridges 42*a*), the first ridges 42*a* extending a first distance from an inner surface of the container 12 and the second ridges 42*b* extending a second distance from an inner surface 40 of the container 12, wherein the first distance is greater than the second distance.

The particular arrangement of abutment assembly 38 shown in the figures comprises a plurality of ridges 42 arranged in a spaced apart relationship with respect to each other around the inner surface 40 of the container upper rim 13 of the container 12. In the particular arrangement of the figures, there are two different type of ridges 42; in particular, there are raised ridges 42*a* and lower ridges 42*b*.

The difference between the raised ridges 42*a* and lower ridges 42*b* is the extent that the ridges 42 extend from the inner surface 40 of the container upper rim 13 of the container 12; in particular, the raised ridges 42*a* extend further from the inner surface 40 than when compared to the lower ridges 42*b*.

As shown in FIG. 7, between each pair of neighbouring raised ridges 42*a* there is located a lower ridge 42*b*. As will be described with reference to the method of operation of the container assembly 10, the fact that there is lower ridge 42*b* between neighbouring ridges 42*a* permits, when applying a deforming action via the user's lip, deforming of the lid upper rim 24 resulting in deformation of the sealed junction (defined by the upper rims 13 and 14 when brought together) and thus permitting flow of fluid trough the junction, which is now unsealed until the squeesing action is removed. In particular, removal of the deforming action returns the lid upper rim 24 to its undeformed condition, resulting in re-sealing of the junction impeding fluid flow out of the container assembly 10.

The container assembly 10 in accordance with the present embodiment of the invention is particularly advantageous because it includes a deformable lid 14 acting simultaneously as (1) a collar for attachment to the container 12 and (2) a flexible cover acting as a valve means which when deformed allow fluid flow. In contrast, conventional self-sealing containers comprise a rigid collar that require to be screwed onto the container, wherein the collar comprises a soft cover, which deformation is limited due to the flow ring of the rigid collar. In particular, in the prior art self-sealing containers, the extent that deformation of the cover is limited is due to the fact that the cover is impeded to deform further due to the flow rings (provided by the rigid cover) stopping any further deformation of the cover.

In accordance with the present embodiment of the invention, the self-sealing container assembly 10 comprises a lid 14 made out of relative flexible material for deformation purposes but configured in such a manner that it may be directly attached to the container 12 avoiding the use of a rigid collar with flow rings that limits deformation of a soft cover as disclosed in the prior art.

In operation, the container 12 is filled with fluid and closed by mounting the lid 14 by pushing the lid 14 into the container 12 such that the flange 18 of the lid 14 rests firmly onto the inner ridge 15 of the container 12. As mentioned above, the lid 14 is configured to operate as a plug when inserted into the container. The fact that the lid 14 is configured as a plug is particularly useful; because, it reduces the number of parts that the container assembly 10 requires to operate as a self-sealing drinking container. In fact, the container assembly 10 in accordance with the present embodiment of the invention comprises a container 12 and a lid 14 in accordance with the present embodiment of the invention and no additional parts are required for the container assembly 10 to properly function providing a relative high fluid flow rate. This is in sharp contrast when compared to the prior art of self-sealing containers, which require a multitude of parts (e.g.: a rigid collar and a soft cover) as was described before in the Background Art section.

The absence of a rigid collar in the container assembly 10 in accordance with the present embodiment of the invention does not limit the extent that the lid upper rim 24 of the lid 14 deforms; thus, fluid flow is greatly enhanced when compared to prior art self-sealing containers.

Further, once the container assembly 10 is filled with fluid, its user may commence drinking the fluid by moving the container assembly 10 towards her/his face in order for locating an angular section of the junction defined by the upper rims 13 and 24 between the lips and apply a deforming action to the junction (defined by the upper rims 13 and 24) for deformation thereof permitting fluid to flow out of the container assembly 12.

Upon removal of the junction from between the lips of the user (without any other action required by the user), the junction is sealed again due to moving into the non-deformed condition for sealing of the junction.

The fact that the container assembly 10 is sealed (impeding fluid exit from its interior) by only removing the junction defined by the upper rims 13 and 24 from between the lips of the user is particularly useful; because, it makes it a self-sealing container particularly useful for use by toddlers or disabled and sick who would not be able to actuate a sealing mechanism to impede fluid flow from the interior of the container 12 once they decide to stop drinking the fluid located inside the container assembly 10.

Modifications and variations as would be apparent to a skilled addressee are deemed to be within the scope of the present invention.

For example, the flange 18 as described and shown in the figures is configured as a ring comprising opening(s) to allow fluid flow therethrough.

However, in an alternative arrangement, the flange 18 may be configured as a cog comprising a plurality of teeth arranged in a spaced apart relationship with respect to each other and extending from the center of the cap 16 towards the inner surface 17 of the container 12. In this particular arrangement, the spacing between the teeth permit fluid flow form the interior of the container 12 to the upper rims 13 and 24.

In another arrangement, the flange 18 may be configured as depicted in the figures but without any openings 30 to allow fluid flow to the upper rims 13 and 24; instead, fluid flow occurs through recesses made into inner walls of the container 12 at the location of the ridge 15 permitting fluid through the recesses when the lid 24 is inserted in the container.

Moreover, the abutment assembly 38 located inside the container 12 just below the top of the container upper rim 13, may have different configuration than when compared to the abutment assembly 38 shown in the figures. Any abutment assembly that provides the self-sealing valve system defined by the upper rims 13 and 24 may work Further, it should be appreciated that the scope of the invention is not limited to the scope of the embodiments disclosed. For example, in an alternative arrangement, the abutment assembly 38 may not be located in the inside the container 12 as shown in, for example, FIG. 9; but, instead the abutment assembly 38 may be located on the lower surface 36 of the lid upper rim 24 as depicted in FIG. 10. The particular arrangement of abutment assembly 38 shown in FIG. 10, comprises a plurality of protrusions arranged in a spaced apart relationship with respect to each surrounding the lower surface 36 of the lid upper rim 24.

Figure 11:
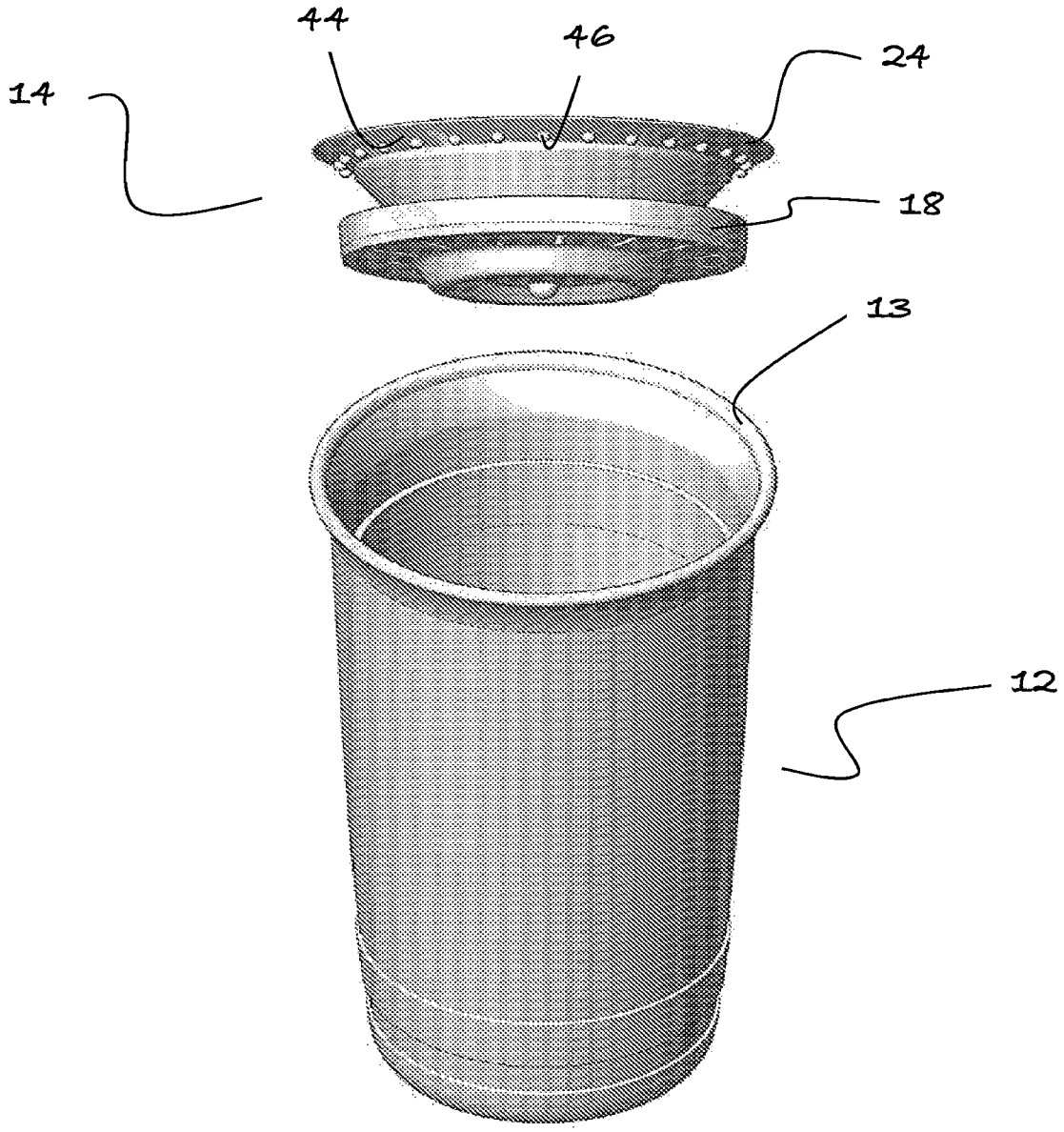
FIG. 11 is a bottom perspective exploded view of a container assembly in accordance with an alternative embodiment of the invention with its lid removed.

FIG. 11 shows this alternative arrangement. As shown in FIG. 11, the rim 24 of the lid 14 comprises at its lower surface 44 (the surface 44 that will abut the upper rim 13 of the container 12) a plurality of protrusions 46 protruding from the lower surface 44 defining the abutment assembly 38 in accordance with this alternative arrangement. When a deforming action is applied via the user's lip, the lid 14 is deformed resulting in deformation of the sealed junction (defined by the upper rims 13 and 14 when brought together) and thus permitting flow of fluid through the junction, which is unsealed until the deforming action is removed. Removal of the deforming action returns the lid upper rim 24 to its undeformed condition, resulting in re-sealing of the junction impeding fluid flow out of the container assembly 10.

Furthermore, the container 12 comprising the abutment assembly 38 has been described as comprising the lid 14 described above and shown in the figures; however in accordance with alternative arrangements, the lid 14 may be any type of lid that may be attached to the container 12 and that is adapted to be selectively displaced between a undeformed condition and a deformed condition.

Throughout this specification, unless the context requires otherwise, the word "comprise" or variations such as "comprises" or "comprising", will be understood to imply the inclusion of a stated integer or group of integers but not the exclusion of any other integer or group of integers.

The invention claimed is:

1. A container assembly, comprising:

a container having a base, a sidewall extending from the base, a container upper rim delimiting the container at one end, an opening, which is defined by an inner surface of the container, extending from the container upper rim toward the base and an inner ridge spaced from the container upper rim extending from the inner surface of the container;

a lid including a body having a conical cap with a lid upper rim and a flange surrounding a portion of the cap, the flange comprising a deformable body adapted to permit fluid flow through the flange to exit the container between the container upper rim and the lid upper rim, wherein the body of the flange is disc-shaped and has a lower surface adapted to permit fluid flow through the lower surface and an outer periphery configured to be arranged on the inner ridge of the container, the outer periphery having an outer side wall, the lower surface surrounding the cap and extending therefrom to abut the outer side wall against the inner surface of the container, wherein the container upper rim is configured to receive the lid upper rim, which is adaptable between an undeformed condition and a deformed condition when mounted on the container upper rim, wherein the container is closable by pushing the lid into the container through the opening defined by the container upper rim such that the flange of the lid rests on the ridge of the container and the container upper rim receives the lid upper rim, the lid thereby operating as a plug fastened to the container via friction force between the outer side wall of the flange and the inner surface of the container, wherein when inserted into the container, the flange of the lid being adapted to generate the friction force between the lid and the container, wherein the container comprises an abutment assembly to deform the lid upper rim upon application of a deforming action to allow fluid flow out of the container, and wherein the abutment assembly being adapted to receive the lid upper rim for selectively displacing at least one portion of the lid upper rim of the lid, the abutment assembly comprising a plurality or ridges arranged in a spaced apart relationship with respect to each other around the inner surface of the container upper rim, the plurality of ridges comprises at least one pair of first ridges and at least one second ridge located between the pair of first ridges, the pair of first ridges extending a first distance from an inner surface of the container and the pair of second ridges extending a second distance from the inner surface of the container, wherein the first distance is greater than the second distance.

2. The container assembly according to claim 1, wherein the cap comprises a reinforcing ring defined by a circular protrusion extending below the flange and defining an area surrounded by the reinforcing ring, and the flange is adapted so that the area is compressed creating a pushing force into the inner surface of the container.

3. The container assembly according to claim 1, wherein the lower surface of the lid comprises at least one opening to allow fluid flow through the flange.

4. The container assembly according to claim 1, wherein the body of the flange is spaced apart form the lid upper rim defining a passage to facilitate fluid flow between the flange and the lid upper rim.

5. The container assembly according to claim 1, wherein the flange is adapted to generate a friction force to resist movement between the lid and the container.

6. The container assembly according to claim 5, wherein an area of the body of the cap located between the flange and lid upper rim is adapted to be compressed to generate a pushing force.

7. The container assembly according to claim 1, wherein the lid is configured to be releasably secured to the container acting as a plug fastened to the container via the friction force.

8. The container assembly according to claim 7, wherein the container includes a plurality of ribs protruding from the inner surface of the container that are spaced apart with respect to each other around the inner surface.

9. The container assembly according to claim 8, wherein the cap is configured as an inverted hollow cone.

10. The container assembly according to claim 1, wherein the outer periphery of the body of the flange is adapted to abut the inner surface of the container generating the friction force.

11. The container assembly according to claim 1, wherein the cap comprises a reinforcing ring defined by a circular protrusion extending below the flange, the reinforcing ring defines an area surrounded by a reinforcing ring, the area is adapted to be compressed creating a pushing force from the flange into the inner surface of the container.

12. The container assembly according to claim 11, wherein the area surrounded by the reinforcing ring is adapted to be compressed into a dome shape creating a downward pushing force and increasing fluid flow when the outer periphery of the flange is located on the inner ridge of the container.

13. The container assembly according to claim 1, wherein the cap has an upper section and a lower section, the upper section having a larger diameter than the lower section.

14. The container assembly according to claim 13, wherein the lower section of the cap comprises a lower surface.

15. The container assembly according to claim 14, wherein the lower surface comprises valve means.

16. The container assembly according to claim 15, wherein the valve means are surrounded by a reinforcing ring of the cap defined by a circular protrusion extending below the flange.

17. The container assembly according to claim 1, wherein the outer side wall of the flange comprises an outer surface for abutment against the inner surface of the container, wherein the flange is configured to be mounted on an inner ridge of the container and surrounded by the inner surface of the container.

18. The container assembly according to claim 1, wherein the body of the lid is manufactured out of Silicon.

19. The container assembly according to claim 18, wherein the Silicon has a shore hardness of 50 A and 70 A.

20. The container assembly according to claim 1, wherein the flange is adapted to allow fluid flow from an interior of the container towards the lid upper rim and to permit exit of fluid from the container upon deformation of the junction between the container upper rim and lid upper rim.

21. The container assembly according to claim 20, wherein the lid is adapted to be compressed in a downward direction creating a downward pushing force when the outer periphery of the flange is located on the inner ridge of the container.

22. The container assembly according to claim 1, wherein the flange of the container has a diameter that is larger than a diameter of the container at the inner surface.

23. The container assembly according to claim 1, wherein the lid upper rim is adapted to be selectively displaced between an undeformed condition and a deformed condition to allow fluid to exit the container.

24. The container assembly according to claim 1, wherein the inner ridge is defined by a plurality of protrusions extending from the inner surface of the container and being arranged in a spaced apart relationship with respect to each other around the inner surface of the container.

25. The container assembly according to claim 1, wherein the inner surface of the container is located below the container upper rim of the container.

26. The container assembly according to claim 1, wherein the abutment assembly is adapted to define a seal once receiving the lid upper rim of the lid.

27. The container assembly according to claim 1, wherein the lid is directly attached to the container upper rim.

28. The container assembly, comprising:

a container having a base, a sidewall extending from the base, a container upper rim delimiting the container at one end, an opening, which is defined by an inner surface of the container, extending form the container upper rim toward the base and an inner ridge spaced from the container upper rim extending from the inner surface of the container;

a lid including a body having a conical cap with a lid upper rim and a flange surrounding a portion of the cap, the flange comprising a deformable body adapted to permit fluid flow through the flange to exit the container between the container upper rim and the lid upper rim, wherein the body of the flange is disc-shaped and has a lower surface adapted to permit fluid flow through the lower surface and an outer periphery configured to be arranged on the inner ridge of the container, the outer periphery having an outer side wall, the lower surface surrounding the cap and extending therefrom to abut the outer side wall against the inner surface of the container, wherein the container upper rim is configured to receive the lid upper rim, which is adaptable between an undeformed condition and a deformed condition when mounted on the container upper rim, wherein the container is closable by pushing the lid into the container through the opening defined by the container upper rim such that the flange of the lid rests on the ridge of the container and the container upper rim receives the lid upper rim, the lid thereby operating as a plug fastened to the container via friction force between the outer side wall of the flange and the inner surface of the container, wherein when inserted into the container, the flange of the lid being adapted to generate the friction force between the lid and the container, and wherein the container comprises an abutment assembly to deform the lid upper rim upon application of a deforming action to allow fluid flow out of the container wherein the abutment assembly being adapted to receive the lid upper rim for selectively displacing at least one portion of the lid upper rim of the lid, the abutment assembly comprising a plurality of ridges arranged in a spaced apart relationship with respect to each other around an inner surface of the container upper rim of the container.

29. The container assembly, comprising:

a container having a base, a sidewall extending from the base, a container upper rim delimiting the container at one end, an opening, which is defined by an inner surface of the container, extending from the container upper rim toward the base and an inner ridge spaced form the container upper rim extending form the inner surface of the container;

a lid including a body having a cap with a lid upper rim and a flange surrounding a portion of the cap, the flange comprising a deformable body adapted to permit fluid flow through the flange to exit the container between the container upper rim and the lid upper rim, wherein the body of the flange is disc-shaped and has a lower surface adapted to permit fluid flow through the lower surface and an outer periphery configured to be arranged on the inner ridge of the container, the outer periphery having an outer side wall, the lower surface surrounding the cap and extending therefrom to abut the outer side wall against the inner surface of the container, wherein the container upper rim is configured to receive the lid upper rim, which is adaptable between an undeformed condition and a deformed condition when mounted on the container upper rim, wherein the flange is adapted to be received within the container and secured within the container by friction forces impeding unintentional opening of the container assembly, wherein the lid is directly releasably attached acting as a plug to the container without the need of a collar being screwed onto the container, wherein the container comprises an abutment assembly to deform the lid upper rim upon application of a deforming action to allow fluid flow out of the container wherein the abutment assembly being adapted to receive the lid upper rim for selectively displacing at least one portion of the lid upper rim of the lid, the abutment assembly comprising a plurality of ridges arranged in a spaced apart relationship with respect to each other around an inner surface of the container upper rim of the container.

30. The container assembly comprising a container having a base, a sidewall extending form the base, a container upper rim delimiting the container at one end, an opening, which is defined by an inner surface of the container, extending from the container upper rim toward the base and an inner ridge spaced from the container upper rim extending from the inner surface of the container;

a lid including a body having a cap with a lid upper rim and a flange surrounding a portion of the cap, the flange comprising a deformable body adapted to permit fluid flow through the flange to exit the container between the container upper rim and the lid upper rim, wherein the body of the flange is disc-shaped and has a lower surface adapted to permit fluid flow through the lower surface and an outer periphery configured to be arranged on the inner ridge of the container, the outer periphery having an outer side wall, the lower surface surrounding the cap and extending therefrom to abut the outer side wall against the inner surface of the container, wherein the container upper rim is configured to receive the lid upper rim, which is adaptable between an undeformed condition and a deformed condition when mounted on the container upper rim, wherein the container is closable by pushing the lid into the container through the opening defined by the container upper rim such that the flange of the lid rests firmly onto the ridge of the container and the container upper rim receive the lid upper rim, the lid thereby operating as a plug fastened to the container via friction force between the outer side wall of the flange and the inner surface of the container, wherein when inserted into the container, the flange of the lid being adapted to generate the friction force between the lid and the container, wherein the container is formed in one piece, and wherein the container comprises an abutment assembly to deform the lid upper rim upon application of a deforming action to allow fluid flow out of the container wherein the abutment assembly being adapted to receive the lid upper rim for selectively displacing at least one portion of the lid upper rim of the lid, the abutment assembly comprising a plurality of ridges arranged in a spaced apart relationship with respect to each other around an inner surface of the container upper rim of the container.

* * * * *